United States Patent [19]

Willcutt et al.

[11] 3,949,448

[45] Apr. 13, 1976

[54] AIR MANIFOLD FOR AUTOMATIC GIN FEEDER

[75] Inventors: M. Herbert Willcutt, Cary; Joseph K. Jones, Raleigh, both of N.C.

[73] Assignee: Cotton Incorporated, New York, N.Y.

[22] Filed: Apr. 16, 1975

[21] Appl. No.: 568,553

[52] U.S. Cl. ..... 19/80 R

[51] Int. Cl.[2] ..... D01G 7/10

[58] Field of Search..... 19/80 R, 81, 145.5, 97.5; 214/16.1 CC, 16.1 CD; 15/300 R, 306 R, 306 A, 306 B, 308, 309

[56] References Cited

FOREIGN PATENTS OR APPLICATIONS

| | | | |
|---|---|---|---|
| 946,333 | 1/1964 | United Kingdom | 19/80 R |
| 988,977 | 4/1965 | United Kingdom | 19/80 R |
| 229,265 | 10/1969 | U.S.S.R. | 19/80 R |

*Primary Examiner*—Dorsey Newton

*Attorney, Agent, or Firm*—Burns, Doane, Swecker & Mathis

[57] ABSTRACT

Apparatus and method for removing fibers from fiber-laden pallets is disclosed in which the bulk of fibers is removed in a primary unloading area thus leaving a thin layer of fibers that are removed by a surface cleaning device. The surface cleaning device included a multiple-blade rotary sweeper which is spaced vertically above the uppermost portion of a pallet to enable the pallet to move therebelow without mechanical interference with the rotary sweeper. A cowling encloses a portion of the periphery of the rotary sweeper to increase the efficacy of fiber removal by the rotary sweeper. The rotary sweeper mechanically engages an upper portion of the thin layer and removes it from the pallet. A suitable gas blast device impinges upon the pallet surface at a location substantially below the rotary sweeper to engage a lower portion of the thin layers of fibers. The gas blast device causes fibers to be lifted upward and into mechanical engagement by the blades of the rotating sweeper. The gas blast device may include an elongated conduit having a plurality of uniformly spaced apart orifice openings or having one or more elongated slots through which pressurized air is exhausted.

23 Claims, 9 Drawing Figures

AIR MANIFOLD FOR AUTOMATIC GIN FEEDER

BACKGROUND OF THE INVENTION

This invention relates generally to apparatus for effecting the removal of fibrous material from pallets. More specifically, this invention concerns apparatus for removing a thin layer of fibers from a pallet surface which is not otherwise removed by primary fiber removal apparatus.

When handling large volumes of fiber material during harvesting and initial processing, it is highly advantageous to modularize the fiber material to facilitate storage and transportation thereof. The assignee of the present invention has developed such a system for modularizing fiber material such as seed cotton to expedite handling and processing thereof. One portion of the system is a mechanized seed cotton handling apparatus disclosed in U.S. Pat. No. 3,749,003 issued to Lambert H. Wilkes et al. on Jan. 31, 1973. The seed cotton handling apparatus receives fiber material from mechanical harvesters and compacts the fiber material onto a suitable pallet. The pallet along with the compacted seed cotton may then be transported by conventional trucks to a geographically distant processing plant such as a cotton gin, for example.

Another portion of the system developed by the assignee hereof concerns the continuous feeding of the modularized fiber material to the processing plant. For the above purpose, an apparatus has been developed which receives and unloads modules comprising a pallet with compacted fiber material. A pending commonly assigned U.S. Pat. application Ser. No. 439,846 filed Feb. 6, 1974, now U.S. Pat. No. 3,897,018, of Lambert H. Wilkes et al. discloses, in detail, an embodiment of such a mechanized continuous feeding apparatus.

While the preferred embodiment of the mechanized unloading apparatus disclosed in the pending patent application is efficient and constitutes a substantial advance over the then existing state of the art, greater flexibility is desirable in the construction of the unloading apparatus to increase the variety of pallets which may be handled and to efficiently remove all the fiber material carried by the pallet.

In this connection, it would be desireable to have vertical spacing between the pallet unlloading apparatus and the pallet supporting apparatus to accommodate a wide variety of pallet cross-sectional configurations without requiring frequent adjustments of the spacing. More specifically, it is desireable to space the unloading apparatus such that pallets with or without pull bars can be handled without mechanical interference.

It would, moreover, be advantageous to provide means for efficient removal of fibrous material from the pallet notwithstanding the vertical spacing between pallet supporting apparatus and pallet unloading apparatus. Another highly desireable feature for augmenting flexibility of the mechanized unloading apparatus resides being able to efficiently clean pallets having flat, rough or corrugated surfaces that may be interchangeably used in conjunction with the unloading apparatus.

Recognizing the above features, a need exists for a mechanized pallet unloading apparatus which provides the desireable flexibility.

OBJECTS AND SUMMARY OF THE INVENTION

It is therefore a general object of the present invention to provide a novel and continuous feeding apparatus for modularized fiber material.

A more specific object of the present invention is to provide such a novel pallet cleaning apparatus in which a sweeper and a gaseous current cooperate to effect a thorough removal of fibrous material from a pallet surface.

Another object of the present invention is to provide a novel pallet cleaning apparatus in which a sweeper reel is provided to mechanically remove an upper portion of a thin layer of fiber material remaining adjacent to a pallet surface while a gaseous current is provided to effect the aero-dynamic removal of the remaining lower portion of the thin layer of fiber material.

A further object of the present invention is to provide a novel pallet cleaning apparatus in which a sweeper reel removes an upper portion of a thin layer of cotton while simultaneously fluffing a remaining lower portion of the thin layer of cotton to facilitate its subsequent removal by aero-dynamic engagement by an air current which impinges upon the surface of the pallet substantially below the sweeper reel.

Yet another object of the present invention of a pallet provide a novel method of cleaning the surface of a pallet by mechanically engaging the uppermost portion of a thin layer of fibrous material and by aero-dynamically engaging a lower portion of the thin layer to effect a complete cleaning of the surface of the pallet.

A still further object of the present invention is to provide a novel apparatus for cleaning a pallet surface which includes a sweeper reel and an air manifold both of which are positioned to accommodate a relatively wide range of typical pallet depths without requiring frequent adjustment of the space between the sweeper reel and a pallet supporting surface.

The above and many other objects of the present invention are substantially accomplished by a continuous feeding apparatus for modularized fiber material in which a rotatable sweeper device spaced above a generally horizontal pallet surface is adapted to mechanically engage and physically strike fibrous material from an upper portion of a thin layer toward a discharge apparatus. The thin layer typically remains on the pallet after passing below apparatus for removing the bulk of fibers from the pallet. Accordingly, by spacing the sweeper device there is no mechanical interference with and hence no damage to the pallets passing therebelow. Moreover, by providing a plurality of radial blades on the sweeper, the uppermost portion of the thin layer of fibrous material is mechanically engaged by the radially outermost tips of the blades thereby dislodging, decompressing and fluffing the remaining fibrous material on the pallet to facilitate subsequent removal.

To effect the removal of the fluffed fibrous material remaining after the action of the sweeper device, a suitable gas blast apparatus may be provided. The gas blast apparatus is preferably circumferentially disposed with respect to the sweeper device and oriented to direct a gaseous current for impingement on a pallet surface at a position substantially below the sweeper device. In this manner, the gaseous curtain lifts the fluffed fibrous material upwardly and into mechanical engagement with the rotating sweeper device. The cooperating sweeper device thereupon physically throws the fibrous material toward discharge apparatus provided therefor.

BRIEF DESCRIPTION OF THE DRAWINGS

The above and many other objects of the present invention will be apparent to those skilled in the art when this specification is read in conjunction with the appended drawings wherein like reference numerals have been applied to like elements and wherein.

DESCRIPTION OF THE PREFERRED EMBODIMENT

Figure 1:
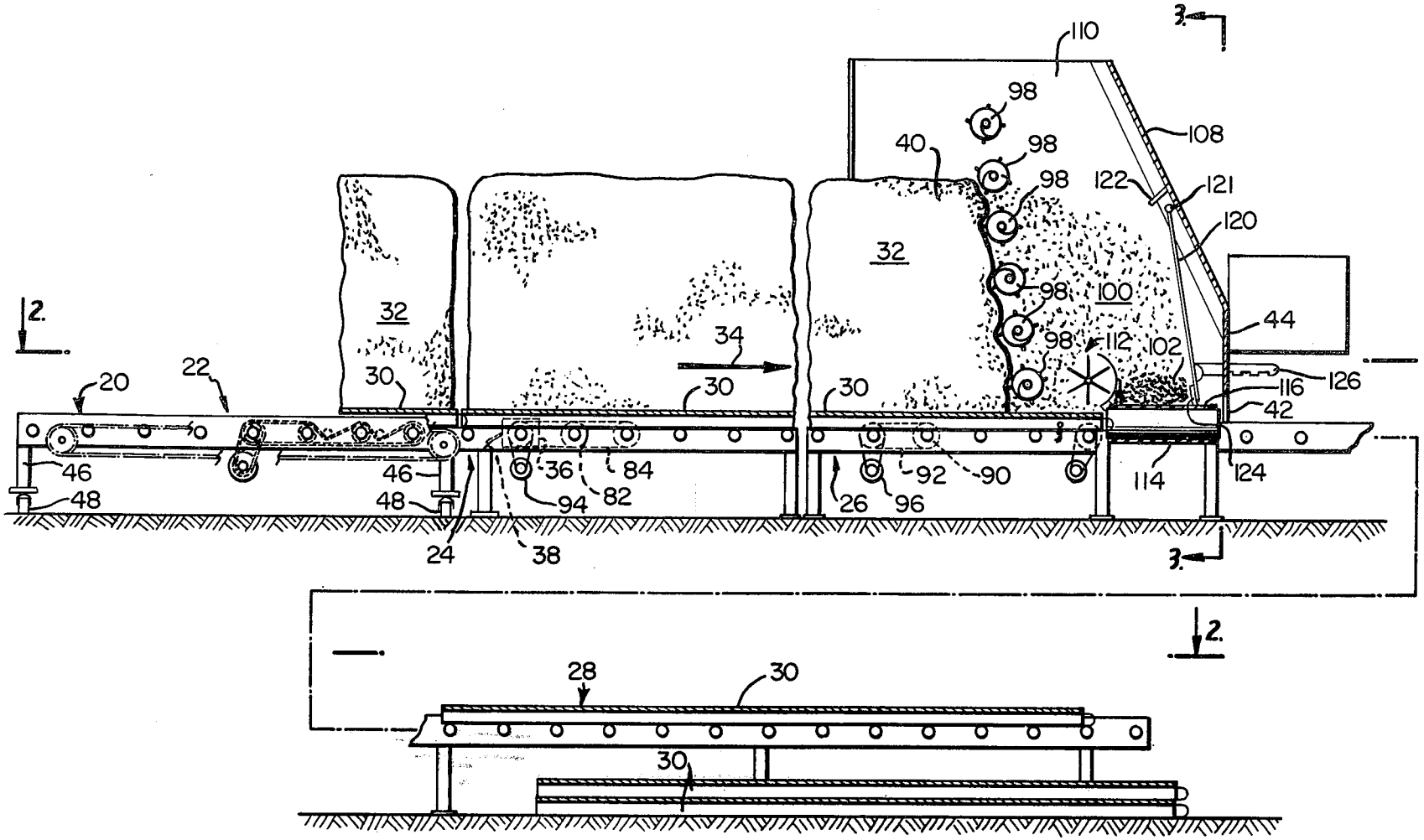
FIG. 1 is a side elevation in partial section illustrating a pallet unloader according to the present invention.

Turning now to FIG. 1 an unloading apparatus suitable for removing compressed fibrous material from a pallet for subsequent movement to fiber processing apparatus is depicted. The feeding apparatus includes a generally horizontal bed 20 for supporting and translating pallets longitudinally therealong. The bed 20 includes a loading portion 22 for receiving loaded pallets directly from a flatbed truck or other similar transportation apparatus. The pallets move at a first predetermined speed from the feeding portion 22 to a transition portion 24 which is adapted to translate pallets at both the first predetermined speed and a second predetermined speed. From the transition portion 24, the pallet moves into an unloading portion 26 where the fibrous material is physically removed from the surface of the pallet. Empty pallets progress forwardly along the horizontal bed 20 and enter a suitable conventional pallet stacker 28 where the individual pallets are stacked for subsequent reuse.

Details of the above structure are disclosed and illustrated in pending, commonly assigned, U.S. Pat. Application, Ser. No. 439,846 filed Feb. 6, 1975 by Lambert H. Wilkes et al. for "Method and Apparatus for the Continuous Feeding of Palletized Fiber Materials." The entire disclosure of that application is hereby incorporated by this reference thereto.

The horizontal bed 20 provides a supporting surface for modules consisting of a pallet 30 and compressed fibrous material 32 supported by a generally horizontal surface of the pallet 30. The fibrous material may be seed cotton or any other material that is advantageously handled in modular form.

As the pallet 30 along with its fibrous material 32 advances from the loading portion 22 to the transition portion 24, the pallet advances in the direction illustrated by arrow 34. In the transition portion 24 the pallet advancement speed may be switched from the first predetermined speed at which it leaves the loading portion 22 to the second lower predetermined speed may, for example, be on the order of 15 feet per minute. The second predetermined speed may be selected in the range of 1 to 4 feet per minute.

To switch from the first predetermined speed to the second predetermined speed and vice versa, a suitable clutching mechanism 36 (see FIG. 2) may be provided at one side of the transition portion 24. A suitable manually operated handle 38 may be provided to switch from one predetermined speed to the other. If desired, automatic remote control of the clutching mechanism may also be used.

The cotton module advances from the transition portion 24 (see FIG. 1) to the unloading portion 26 at the second predetermined speed. As the pallet 30 passes through the unloading portion 26, the leading edge 40 of the fibrous material stacked thereon is engaged by suitable apparatus which first removes the bulk of fibrous material and then cleans the pallet surface. Subsequently, the pallet 30 emerges from a fiber egress opening 42 defined in a vertical wall 44 of the unloading portion 26.

It will be appreciated by those skilled in the art that the loading portion 22, the transition portion 24, the unloading portion 26 and the pallet stacker 28 may be used independently of one another depending upon the requirements of a given fiber processing facility.

The loading section 22 may be provided with a plurality of legs 46 having ground engaging rollers 48 mounted at the lower end thereof. The rollers 48 permit the loading section 22 to be moved laterally with respect to the direction 34 of fiber moldule movement therealong (see phantom lines 50, 52 of FIG. 2). The loading portion 22 is adapted for movement to either side of the position in which it is aligned with the transition section 24 to facilitate the loading of cotton modules onto the loading portion 22 from transporting devices such as tractor trailers and the like.

Figure 2:
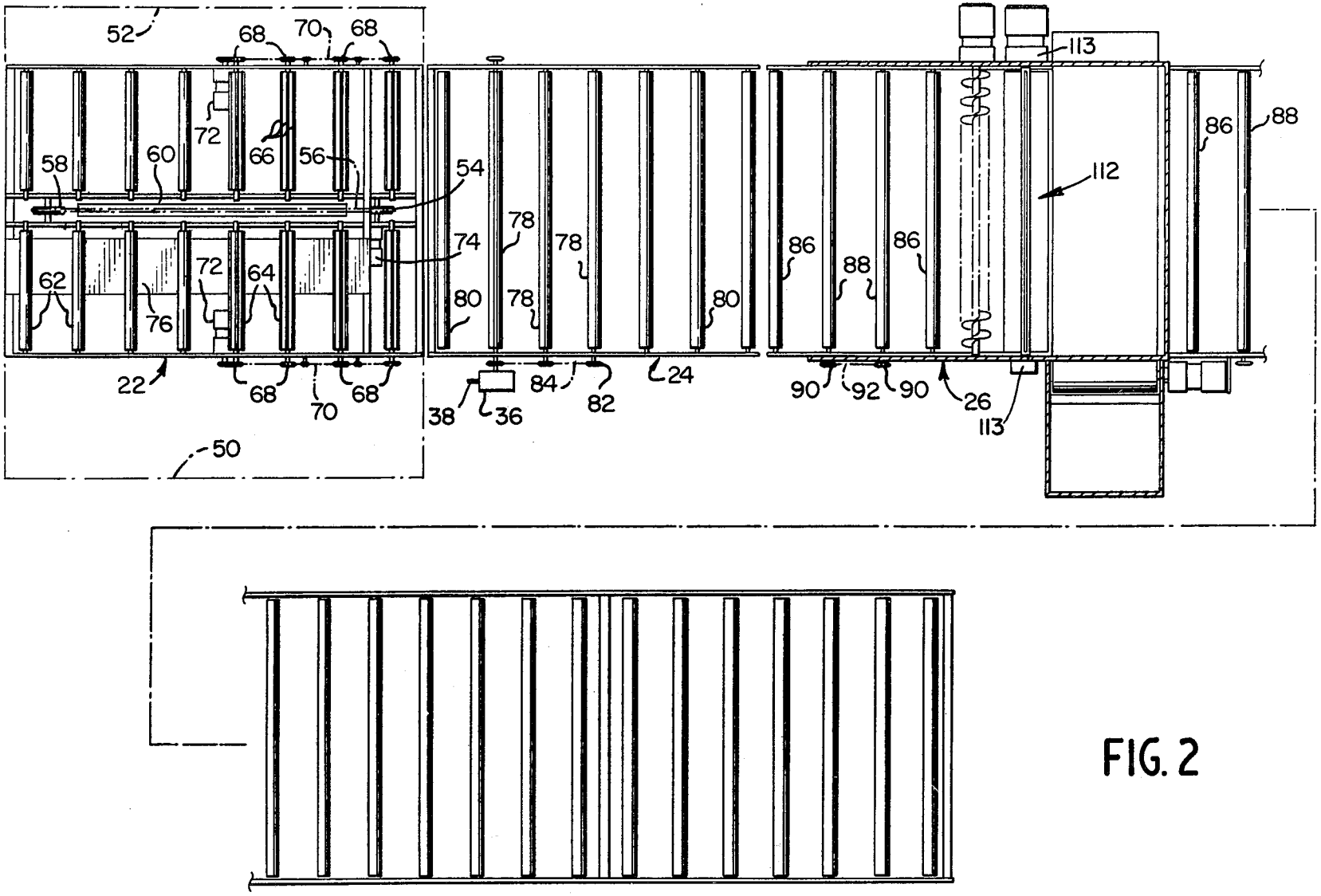
FIG. 2 is a plan view in partial section taken along the line 2—2 of FIG. 1.

More specifically, a tractor trailer may be driven along side and beyond the loading section 22 so that the back end of the tractor trailer is in general lateral alignment with the forward end of the loading section 22. Alternately, the tractor trailer may be backed into approximate alignment with the loading portion 22. The loading portion 22 may be moved laterally to either side towards a position in alignment with the tractor trailer. The ability to move the loading portion 22 laterally has been found to eliminate unnecessary time consumed by repeatedly backing a tractor trailer into a properly aligned position with respect to the loading portion 22. Accordingly, by moving the loading section 22 laterally as depicted in FIG. 2, the tractor trailer need only be backed into position once thereby reducing waiting time for drivers and improving the speed with which modules can be unloaded.

To off-load a module from a tractor trailer onto the loading portion 22, a chain drive conveyor may be provided. The chain drive conveyor may include a driving sprocket 54, an idle sprocket 58 and a chain 56 supported therebetween. Preferably the chain drive conveyor is positioned generally centrally with respect to the loading portion 22 to uniformly distribute forces on the modules during loading thereof. The upper run of the chain 56 may be supported on a surface 60 that eliminiates catenary droop otherwise naturally occurring when a generally horizontal chain is suspended between two spaced apart points.

Figure 5:
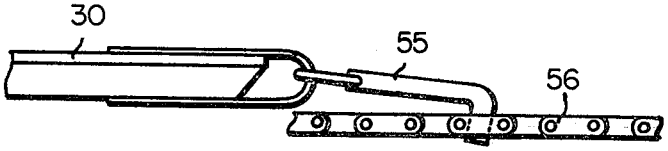
FIG. 5 is a detail illustration of apparatus for initially engaging and moving pallets.

A suitable hook device 55 is attached to the forward edge of the pallet for engagement with the chain 56 (see FIG. 5). As the chain 56 (see FIG. 2) is advanced by the driving sprocket 54, the pallet 30 is pulled onto the loading portion 22 from a position on a tractor trailer. While the chain conveyor apparatus is illustrated as centrally disposed with respect to the loading portion 22, the chain conveyor may also be positioned at one side or at any convenient intermediate position of the feeding table 22. As noted, the central position is advantageous in that forces exerted on the module are generally evenly distributed.

The loading portion 22 may include a plurality of short idling rollers 62 adjacent the end thereof which facilitate the support and accommodate movement of a pallet 30 onto the loading portion 22. A plurality of short powered rollers 64 are also provided and comprise a loading conveyor for the advancement of pallets along the loading portion 22 and onto the subsequent transition portion 24. The short powered rollers may be provided with suitably roughened surfaces 66 to facilitate engagement with the bottom of a pallet.

Each short powered roller 64 may be provided with a suitable gear 68 at the outermost end thereof to supply torque necessary to rotate the roller 64 and thereby advance a pallet. To ensure that all the short powered rollers 64 rotate at a uniform angular speed, the gears 68 may be interconnected by suitable chain 70. A suitable source of power 72 may be provided to drive the short powered rollers 64 disposed on each side of the chain conveyor. Moreover, a suitable power source 74 may be provided to drive the sprocket 54 for the chain 56.

The power sources 72, 74 may be hydraulic motors, for example. However, it is also possible to use electric motors or other suitable conventional devices.

Alternatively, the loading portion 22 may be provided with a winch for off-loading modules from a tractor trailer. Such a winch may be provided with a nylon cable for attachment to a pallet 30. Nylon would be a preferred cable material due to its light weight and the absence of coiling tendency normally associated with wire cables. When using a winch, supports for the sprockets 54, 58 are not necessary. Accordingly, the idling rollers 62 and the power rollers 64 may extend continuously between the supporting side rails without interruption to provide an operating area for a chain 56.

A catwalk 76 may be provided to assist the movement of workmen on the loading portion 22 while a pallet is being positioned thereon. The catwalk 76 may extend substantially along the length of the loading portion 22 at a position adjacent to the chain conveyor. Preferably, the catwalk 76 is positioned such that it underlies the idling rollers 62 and the short powered rollers 64. In this manner, the catwalk 76 does not interfere with the movement of the pallet along the feeding table 22.

With continued reference to FIG. 2, a pallet advances from the loading portion 22 onto the transition portion 24 which is provided with a plurality of long powered rollers 78. The service table 24 may also include idling rollers 80, as desired. The long powered rollers 78 may be provided with roughened surface, as in the case of the short powered rollers 64, to facilitate driving engagement with the bottom of a pallet. In addition, each long powered roller 78 may have a suitable gear 82 positioned at the outermost end thereof. A suitable chain 84 may interconnect the clutching mechanism 36 and the gears 84. In this manner, the long powered rollers 78 are constrained to move at a uniform angular velocity and comprise a transition conveyor which may be clutched between the first and second predetermined speeds.

As the pallets move from the transition portion 24 at the second predetermined speed, they enter the unloading portion 26. The unloading portion 26 may include one or more long idling rollers 86 and a plurality of long powered rollers 88. Each long powered roller 88 may be provided with a suitably roughened surface to facilitate engagement with the pallet surface, as was the case with the short powered rollers 64. The long powered rollers 88 constitute a feeding conveyor. Each roller 88 may be provided with a suitable gear 90 at the outermost end thereof and be interconnected by a suitable chain 92 with the gears 90 of the other long powered rollers 88 thereby constraining them to move at a uniform angular speed.

Returning to FIG. 1 it will be noted that the long powered rollers of the transition portion 24 may be driven by a suitable power means 94. Similarly, the long powered rollers 88 of the unloading portion 26 may be driven by a suitable power means 96. As in the case of the power devices in the loading portion 22, the power devices 94, 96 may comprise conventional hydraulic motors, electrical motors or the like.

The leading portion 40 of fibrous material 32 carried by a translating pallet 30 is engaged by a plurality of vertically spaced-apart rotating augers 98 which break loose the fibrous material from the pallet 30 and allow the loosened fibers 100 to drop and coalesce into a pile 102 on a discharge device. Alternately, a plurality of spaced-apart rotating spiked cylinders may be substituted for the rotating augers 98.

Figure 3:
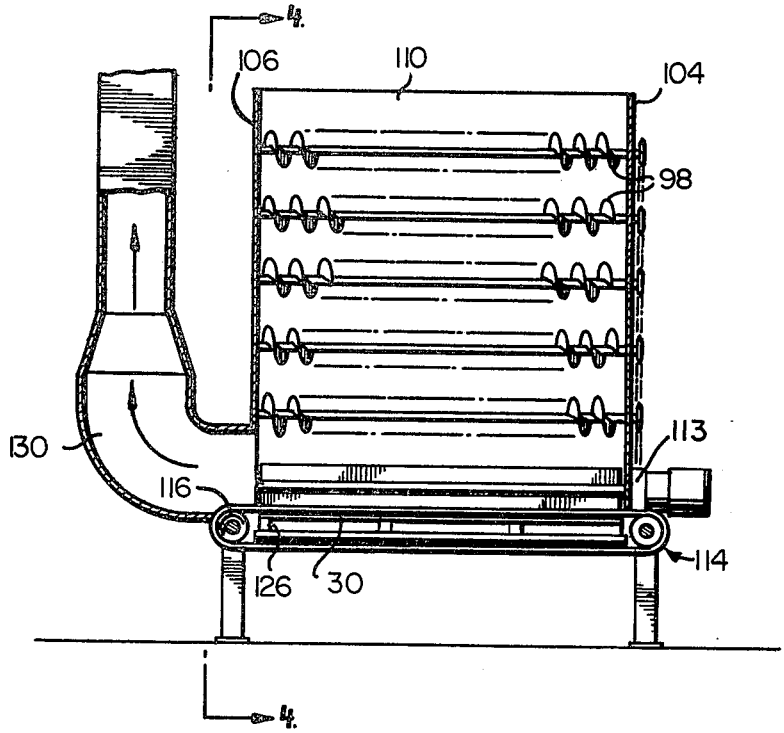
FIG. 3 is an elevation in partial cross-section taken along the line 3—3 of FIG. 1 to illustrate the vertical positioning of a rotary sweeper, a transverse conveyor and rotating augers.

Turning now to FIG. 3 it will be seen that the rotating augers 98 are generally horizontally disposed between side walls 104, 106 of a chamber 110. The chamber 110 is defined in part by the side walls 104, 106 and in part by the vertical wall 44 (see FIG. 1) and the generally inclined vertical wall 108 attached to the upper edge of the short vertical wall 44. As a pallet 30 advances past the breaking apparatus, a suitable sweeping apparatus 112 is provided to remove a thin layer of fibrous material adjacent the pallet surface which is not removed by the rotating augers 98. The loosened fibers 100 collect in a pile 102 on a generally transverse conveyor 114.

To aid coalescence of the fibers on the upper moving surface 116 of the transverse conveyor and to inhibit spillage from the surface 116, a suitable deflecting device may be provided in the chamber 110. The deflecting device includes a pivotally mounted movable wall member 120 (see FIG. 1) which is adapted for rotatable movement about its upper edge by connection to a rod 121 pivotally connected to the upstanding side walls 104, 106. To impede loosened fibers 100 from passing between the deflecting wall 120 and the inclined stationary wall 108 a suitable deflecting plate 122 may be provided adjacent the pivotal mounting of the movable wall 120. It will be appreciated by those skilled in the art that the module unloading apparatus may be operated without a deflecting wall 120.

The lower edge of the movable wall is provided with a suitable resilient flashing member 124 which effectively seals the movable wall 120 against the upper moving surface 116. A suitable adjustment mechanism comprising a notched handle 126 that engages a suitable recess of the generally vertical wall 44 may be provided to laterally position the lower edge of the movable wall 120 with respect to the upper moving surface 116 of the transverse conveyor 114.

It will be apparent form FIG. 3 that as the pallet 30 advances beyond the transverse conveyor 114 the pallet passes below the upper moving surface 116 and above the lower moving surface 126 thereof. In this manner the fibrous material piled on the upper moving surface 116 is prevented from falling onto the upper surface of the pallet 30 as it moves toward the pallet stacker 28.

Figure 4:
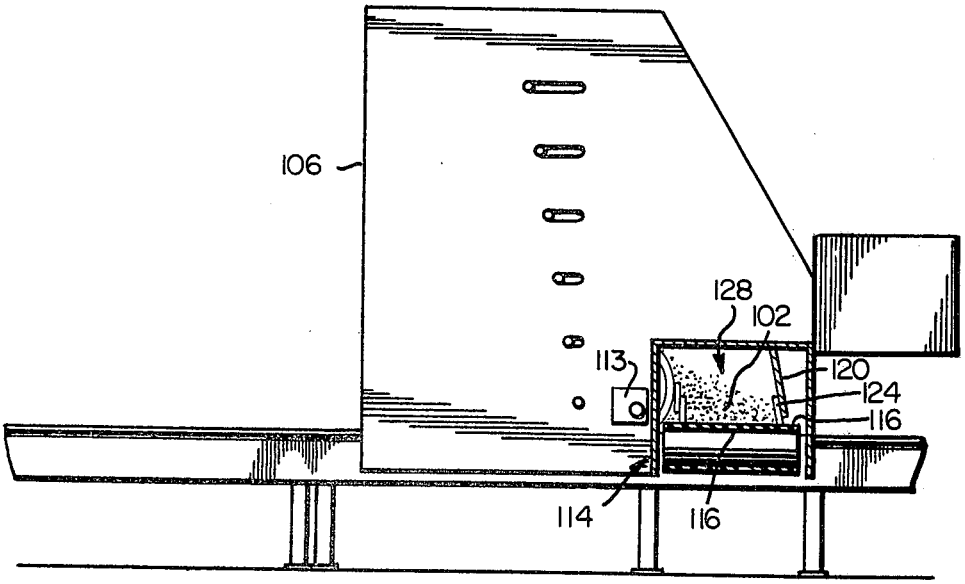
FIG. 4 is a partial side elevation illustrating a fiber egress opening.

Turning now to FIG. 4 the side wall 106 includes a fiber egress opening 128 through which fibrous material piled on the upper moving surface 116 is removed from the chamber 110. The fibrous material may be deposited in a suction tube 130 (see FIG. 3) for entrainment in an air current conveyor. Such a suction tube 130 may be connected directly to subsequent fiber handling apparatus such as a cotton gin. Alternatively, the transverse conveyor 114 may dump the loosened fibers directly onto other conveying apparatus for movement into fiber processing apparatus.

Figure 6:
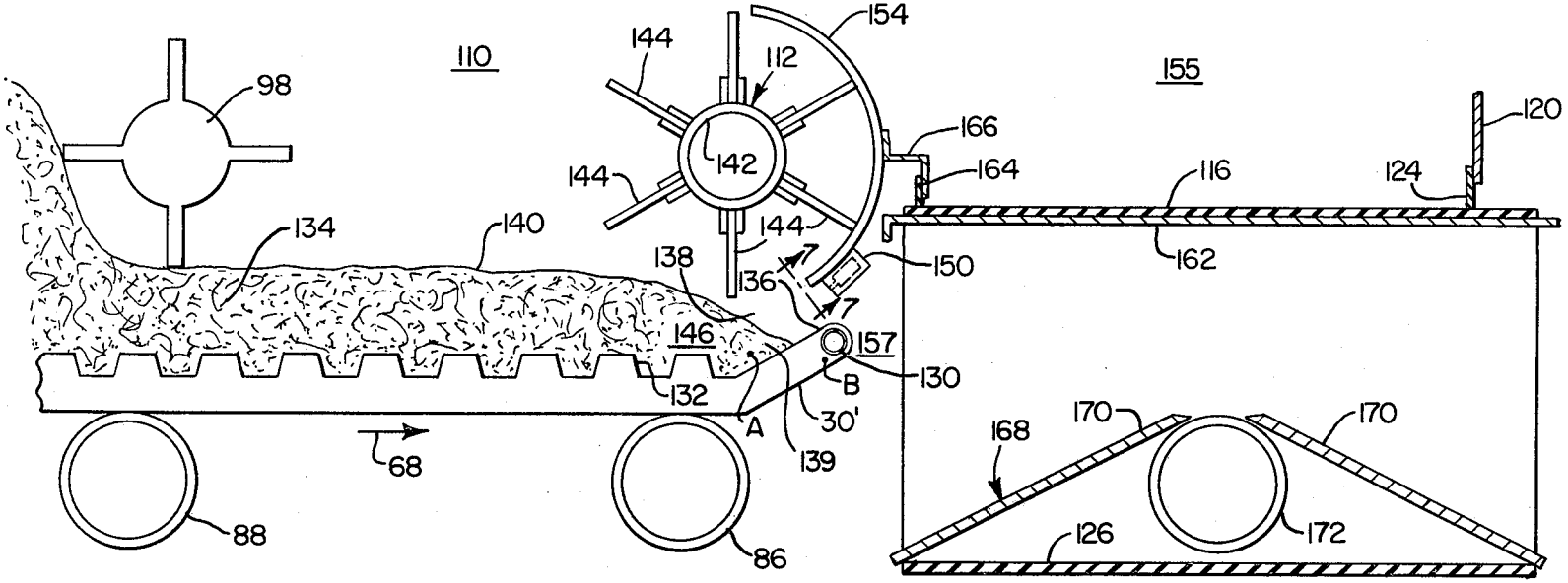
FIG. 6 is a detail view in partial cross section that illustrates apparatus for cleaning the surface of pallets after the bulk of fibers has been removed therefrom.

Turning now to FIG. 6, the leading edge portion of a corrugated metal pallet 30', which may be used with the module feeding apparatus of the present invention is disclosed in more detail. The pallet 30', which may be of the corrugated metal type, is provided with a pull bar 130 at the leading edge portion thereof to which a suitable hook means may be attached in order to move the pallet 30' onto the loading portion 22 of FIG. 1.

The pallet 30' (see FIG. 6) may be provided with a generally horizontal surface having transversely oriented corrugations 132 that enhance stiffness against transverse bending. As the pallet 30' moves in the direction of the arrow 68 along the powered roller 88 and the support roller 86 of the unloading portion 26, a thin layer 134 of fibrous material remains on the pallet surface 132 and in the corrugations. This layer 134 remains since the lowermost disperser reel or horizontal auger 98 must be spaced above the pallet to prevent interference with and possible damage to the pallet 30'. At the advancing end of the pallet 30', the pull bar 130 is positioned slightly below the vertically uppermost portion 136 of the pallet 30'.

The rotary sweeper 112 is positioned between the breaker device including the rotating augers and the discharge device including the transverse conveyor to mechanically engage a portion of the remaining fibrous material of the layer 134 on the pallet surface.

To avoid interference with and damage to a pallet 30', the sweeper reel 112 is spaced above the pallet supporting and translating apparatus such that its lowermost portion does not engage the uppermost portion 136 of the pallet 30'. In this manner the pallet 30' advances longitudinally below the sweeper 112 with no possibility of damage thereto.

Since the pallets 30, 30' used with the present invention may vary in type being used and in thickness, the sweeper 112 may be provided with conventional adjusting screws 113 at each end to permit vertical adjustment thereof. Typically, the sweeper 112 can be adjusted from 2 to 6 inches above the support roller 86 disposed therebelow. Preferably, the sweeper reel 112 is spaced vertically above the uppermost portion 136 of the pallet 30' by a distance of one half to one inch such that a clearance 138 is obtained therebetween even when other types of pallets are used. With the sweeper 112 thus spaced and rotating in a direction such that the lowermost portion thereof moves opposite the direction 68 of pallet advancement, the sweeper 112 mechanically engages an upper portion 140 of the thin layer 134 of fibrous material remaining on the pallet 30'.

Figure 9:
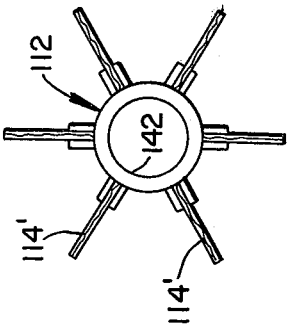
FIG. 9 is a partial view, similar to FIG. 6, of an alternate embodiment of the sweeper reel.

The sweeper 112 itself may comprise, for example, a hub member 142 having a rotationally symmetric cross section to which a plurality of generally radially extending vanes 144 are connected. The radially extending vanes 144 are preferably equiangularly spaced about the periphery of the hub member 142 to improve dynamic balancing of the sweeper 112. In addition, the vanes may be fabricated from a suitable flexible material. Both rubber and nylon bristle brush material 144' (see FIG. 9) have been found satisfactory for the blade material. While a larger or smaller number of vanes 144 (FIG. 6) may be used, the present invention uses a six bladed sweeper 112. The use of six blades permits the sweeper 112 to rotate at a lower angular speed than a fewer number of blades while maintaining the same frequency of mechanical contact with the fibrous material. In addition, the angle between adjacent blades of a six bladed sweeper 112 is smaller than a sweeper having fewer blades augmentating a gas blast apparatus to be described.

With rotary sweeper 112 rotating at 650 rpm, for example, the radially extending vanes 144 mechanically engage the upper portion 140 of the thin layer 134 of fibrous material adjacent the surface. As the vanes 144 engage the fibrous material, it is batted back toward the rotating augers 98 or up toward the chamber 110 such that the material may be deposited on the upper moving surface 116 of the generally transverse conveyor. Simultaneously, the actions of the sweeper 112 effectively decompresse and result in fluffing of the fibrous material remaining adjacent the pallet surface in the lower portion 146 of the thin layer 134 by virtue of the fibrous nature of the material and the mechanical engagement of the upper portion 140.

The pallet 30' may be efficiently cleaned by providing a suitable gas blast device which may include a gas manifold 150 to direct a gaseous current in the direction opposed to pallet advancement and in the same direction as the rotary movement of the sweeper 112. The gaseous current is preferably directed toward the clearance 138 substantially below the sweeper 112. More precisely, the gaseous current is preferably directed toward a zone 139 on the surface of the pallet 30. The zone 139 extends between a first point A (see FIG. 6) directly below the lowermost position swept by a vane 144 and second point B approximately two inches from the first point A in the direction of pallet advancement. This positioning of the gaseous current insures that the impinging current will aerodynamically engage and lift the lower portion 146 of the thin layer 134 upwardly into mechanical engagement with the rotary sweeper 112.

The gas blast device distributes the gaseous current longitudinally along the sweeper so that all fibrous material remaining on the pallet will be removed. To eliminate potential mechanical interference with an advancing pallet 30', the gas device must be spaced above the pallet supporting apparatus at least as high as the lowermost portion of the sweeper 112. A position between 3 and 4 inches vertically above the lowermost portion of the sweeper has been found to be satisfactory.

By positioning the gas blast device on the periphery of the sweeper and orienting the device such that the gaseous current flows in a direction generally tangential to the direction of the sweeper rotation, effective cooperation between the sweeper and the gaseous current is facilitated.

The pallet cleaning effects of the gaseous current produced by the gas manifold 150 may be augmented by providing a cowling 154 between the sweeper 112 and the gas manifold 150. The rotating vanes 144 cooperate with the cowling 154 to blow some additional air in the direction of the gaseous current. Preferably the cowling 154 is arcuately configured in a peripheral disposition about the sweeper 112 and subtends a central angle at least as great as that central angle subtended between three serially adjacent vanes 144 of the sweeper 112. The cowling 154 also inhibits fibrous material in the discharge area 155 from returning to the pallet area 157 below the sweeper 112 by providing a physical barrier therebetween. In addition, the cowling increased the efficacy of the sweeper 112 by limiting accessability of fibrous material in the discharge area to the rotating vanes 144 of the sweeper 112.

Figure 7:
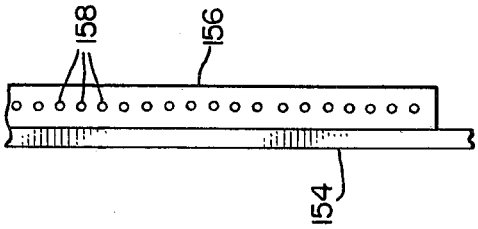
FIG. 7 is a detail view taken along line 7—7 of FIG. 6 and illustrates a manifold with orifices to obtain a gaseous curtain.

Turning now to FIG. 7, the gas manifold 150 may comprise, for example, an elongated conduit 156 attached to the cowling 154 and having a plurality of orifices uniformly spaced apart longitudinally therealong. It has been found that 1/16 inch diameter orifices spaced at two inch intervals along the conduit 156 are adequate to provide a plurality of gas jets that define a gaseous current to effect removal of the lower portion 146 of thin layer 134.

Figure 8:
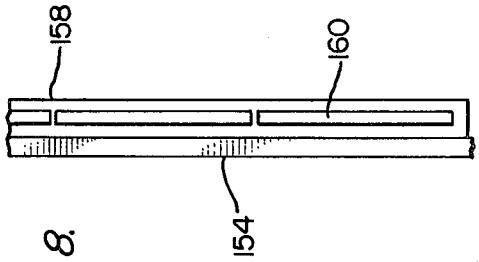
FIG. 8 is a detail view similar to FIG. 7 which depicts a manifold with elongate slots to effect the generation of a gaseous curtain.

An alternate configuration of the gas manifold is depicted in FIG. 8. The conduit 158 is provided with one or more longitudinally aligned elongated slots 160 having a transverse opening of about 1/16 of an inch. While several elongated slots 160 are illustrated, two slots, each extending along the conduit 158, may be used.

Suitable sources of gas may be connected to the manifold 158 to provide a gaseous current. A suitable source of air capable of supplying 30 to 40 cfm at 20 psig has been found sufficient to provide an effective air current when connected to the manifold of FIG. 7. A suitable air source producing 300 to 800 cfm of air at 5 psig would be adequate to produce an air current when connected to the manifold of FIG. 8.

Returning to FIG. 6 the upper moving surface 116 of the transverse conveyor is slidably supported on a table 162. As noted earlier, a movable wall 120 is provided with a rubber flashing 124 to prevent fibers from slipping off the lateral edge of the upper moving surface 116. Analogously, a second rubber flashing 164 may be provided at the opposite edge of the upper moving surface to prevent cotton from inadvertently being displaced from the upper moving belt on that side. The second rubber flashing 164 may be suitably connected by member 166 to the cowling 154.

Since it is possible for some fibrous material to escape from the interaction of the sweeper 112 and the gas blast device, a belt shield 168 may be provided to prevent the fibrous material from being deposited on the upper horizontal surface of the lower extend of the moving belt 126. Such a deposit of fibrous material might eventually accumulate and adversely interfere with the movement of the transverse conveyor around its supporting rollers. The belt shield 168 may comprise sheet metal members 170 suitably connected to a tube 172 so that a clearance of ½ inch remains between the uppermost portion of the belt shield 168 and the normal path of movement of the bottom of a pallet.

It should now be apparent that there has been provided in accordance with the present invention an efficient device for removing the fibrous material from the surface of a pallet. It will, moreover, be apparent to those skilled in the art that numerous modifications, variations, substitutions and equivalents may be provided for various features of the invention as disclosed herein. Accordingly, it is expressly intended that all such modifications, variations, substitutions and equivalents that fall within the spirit and scope of the invention as defined in the appended claims be embraced thereby.

What is claimed is:

1. In apparatus for removing fibers stacked on a pallet, the apparatus having means for supporting and translating a pallet, breaker means for loosening fibers stacked on the pallet, and discharge means for conveying loosened fibers to subsequent fiber handling apparatus, an improved pallet sweeping means for removing fibers escaping engagement by the breaker means, comprising:

rotatable sweeper means positioned between the breaker means and discharge means, spaced above the means for supporting and translating such that the pallet freely passes therebetween, operable to move fibers adjacent the pallet to the discharge means; and gas blast means positioned adjacent the sweeper means and the discharge means and being operable to direct a gaseous current toward the pallet surface as the pallet passes between the sweeper means and the means for supporting and translating.

2. The apparatus of claim 1 wherein the sweeper means is spaced to provide a clearance of approximately one inch above the pallet to assure no mechanical interference between the sweeper means and the pallet passing therebelow.

3. The apparatus of claim 1 wherein the gas blast means includes a manifold means for distributing the gaseous current longitudinally along the sweeper means.

4. The apparatus of claim 3 wherein the manifold means includes a plurality of uniformly spaced apart orifices which direct a corresponding plurality of gaseous jets toward the advancing pallet to remove fibers adjacent thereto.

5. The apparatus of claim 3 wherein the manifold means includes a plurality of elongate slots which direct a gaseous curtain toward the advancing pallet to remove fibers adjacent the surface thereof.

6. The apparatus of claim 3 wherein the manifold means is positioned to direct the gaseous current downwardly toward a zone on the advancing pallet between a location directly below the lowermost part of the sweeper means and a location forward thereof in the direction of pallet advancement such that loose fibers remaining after an advancing pallet passes the sweeper means are lifted for engagement by the sweeper means.

7. The apparatus of claim 1 further comprising a cowling means disposed between the sweeper means and the gas blast means and operable to inhibit fibers encountering the discharge means from being returned to the pallet area through the sweeper means.

8. The apparatus of claim 7 wherein the gas blast means is connected adjacent the lowermost position of the cowling means such that the gas blast means is positioned at least as high as the lowermost portion of the sweeper means.

9. Pallet surface cleaning apparatus for use in removing fibers from fiber-laden pallets comprising:

rotatable sweeper means having a direction of rotation, operable to be spaced above the highest portion of a generally horizontal pallet surface to allow the pallet to pass horizontally therebelow without mechanical interference, and operable to mechanically engage a first portion of the fibers for removal;

gas blast means operable to direct a gaseous current toward a pallet surface such that the gaseous current impinges upon the pallet surface substantially below the sweeper means, the gas blast means being positioned at the periphery of the sweeper means, and aligned to induce an air current in the direction of rotation of the rotatable sweeper means to aerodynamically engage a second portion of the fibers for removal.

10. The pallet surface cleaning apparatus of claim 9 including cowling means positioned at the periphery of the sweeper means and operable to limit fiber access to a portion of the rotatable sweeper means.

11. The pallet surface cleaning apparatus of claim 9 wherein:

the rotatable sweeper means includes a plurality of generally radial blades and is adapted for rotation such that the lowermost blade moves in a direction opposed to the direction of pallet advancement;

the gas blast means directs a gaseous current in the direction opposed to pallet advancement; and a cowling means is positioned between the sweeper means and the gas blast means.

12. The pallet cleaning apparatus of claim 11 wherein:

the sweeper means includes six flexible equiangularly-spaced blades; and the cowling means subtends an arc at the periphery of the sweeper means which is at least as large as the arc subtended by three mutually adjacent blades to limit fiber access to the sweeper means.

13. The pallet cleaning apparatus of claim 12 wherein the sweeper blades are fabricated of rubber.

14. The pallet cleaning apparatus of claim 12 wherein the sweeper blades are fabricated of brush members.

15. The pallet cleaning apparatus of claim 9 including means operable to vertically adjust the sweeper means to accommodate pallets of different thickness.

16. The pallet cleaning apparatus of claim 9 wherein the gas blast means includes a conduit having a plurality of orifices uniformly spaced therealong and operably positioned to direct a gaseous jet toward the pallet surface.

17. The pallet cleaning apparatus of claim 9 wherein the gas blast means includes a conduit having an elongated slot operably positioned to direct a gaseous curtain toward the pallet surface.

18. The pallet cleaning apparatus of claim 17 wherein the conduit includes a plurality of longitudinally aligned elongated slots.

19. A method of removing fibers from a generally horizontal surface of a translating pallet comprising the steps of:

removing the bulk of fibers from the pallet by engagement with a plurality of rotating members such that a thin layer of fibers remains adjacent to the pallet;

mechanically engaging an upper portion of the thin layer to remove the upper portion from the pallet while fluffing fibers of a lower portion of the thin layer adjacent to the pallet; and directing a gaseous current toward the pallet surface from a position vertically thereabove to aerodynamically engage the lower portion of the thin layer and remove the lower portion from the pallet.

20. The method of claim 19 wherein the step of mechanically engaging includes the steps of:

rotating a sweeper having a plurality of outwardly extending blades such that the blades are spaced above an uppermost portion of a pallet; and batting loosened fibers with the blades of the sweeper toward a discharge area.

21. The method of claim 19 wherein the step of directing a gaseous current includes the steps of:

aligning the gaseous current to impinge the pallet surface substantially below a rotary sweeper; and lifting the lower portion of the thin layer from the pallet surface to blades of the sweeper by deflecting the air jet with the pallet surface.

22. The method of claim 21 further including the step of engaging the lifted fibers from the lower portion of the thin layer with the sweeper for mechanical removal thereof.

23. The method of claim 21 further including the step of augmenting the gaseous curtain by partially surrounding the sweeper with an arcuate cowling.

* * * * *